US005433459A

United States Patent [19]

Liu

[11] Patent Number: 5,433,459

[45] Date of Patent: Jul. 18, 1995

[54] MULTI-PURPOSE CARRIAGE

[76] Inventor: Yang-Ting Liu, P.O. Box 82-144, Taipei, Taiwan

[21] Appl. No.: 987,181

[22] Filed: Dec. 8, 1992

[51] Int. Cl.[6] ..... B62B 3/02

[52] U.S. Cl. ..... 280/30; 280/648; 280/651; 297/118; 297/129

[58] Field of Search ..... 280/30, 647, 648, 651, 280/654, 655.1, 657, 643, 644, 47.18; 297/118, 129

[56] References Cited

U.S. PATENT DOCUMENTS

| | | | |
|---|---|---|---|
| 2,957,700 | 10/1960 | Beaurline | 280/654 X |
| 3,137,511 | 6/1964 | Weil et al. | 280/30 X |
| 4,505,495 | 3/1985 | Foss et al. | 280/651 |
| 4,997,200 | 3/1991 | Earls | 280/648 |
| 5,050,899 | 9/1991 | Stensby | 280/648 X |
| 5,213,360 | 5/1993 | Lin | 280/30 X |

*Primary Examiner*—Eric D. Culbreth
*Assistant Examiner*—Peter C. English
*Attorney, Agent, or Firm*—Alfred Lei

[57] ABSTRACT

This invention relates to a multi-purpose carriage and in particular to one including an upper frame provided with two upper supports each having a toothed member at the lower end, two transverse rods mounted between the two upper supports, each of the upper supports having a fixing block, a slider and a guiding rack and being provided with a telescopic rod, each slider having a positioning device for mounting on the guiding rack, a head rest rod pivotally connected with the upper end of the upper supports and having an adjustable rest, a lower frame provided with two lower supports each having at the upper end a toothed member engaged with the toothed member of the upper frame, and a compound rack engaged with the lower supports of the lower frame and composed of two telescopic rods each connected with a L-shaped rod, the L-shaped rod being provided with a plurality of wheel assemblies, whereby the carriage may be used as a seat, a wheeled chair, a bed, and a baby carriage.

2 Claims, 13 Drawing Sheets

MULTI-PURPOSE CARRIAGE

BACKGROUND OF THE INVENTION

It is found that the prior art carriage on the market has only one usage and so there is a need for a carriage with multi-functions. However, the multi-purpose carriages on the market are unsatisfactory in use and have to be improved.

Therefore, it is an object of the present invention to provide a carriage which may obviate and mitigate the above-mentioned drawbacks.

SUMMARY OF THE INVENTION

This invention relates to an improved multi-purpose carriage.

It is the primary object of the present invention to provide a multi-purpose carriage which may be used as a seat, a chair, a bed or a baby carriage as desired.

It is another object of the present invention to provide a multi-purpose carriage which is easy to carry.

It is still another object of the present invention to provide a multi-purpose carriage which is small in size.

It is still another object of the present invention to provide a multi-purpose carriage which is simple in construction.

It is a further object of the present invention to provide a multi-purpose carriage which is economic to produce.

Other objects and merits and a fuller understanding of the present invention will be obtained by those having ordinary skill in the art when the following detailed description to the preferred embodiment is read in conjunction with the accompanying drawings.

DETAILED DESCRIPTION OF THE PREFERRED EMBODIMENT

Figure 1:
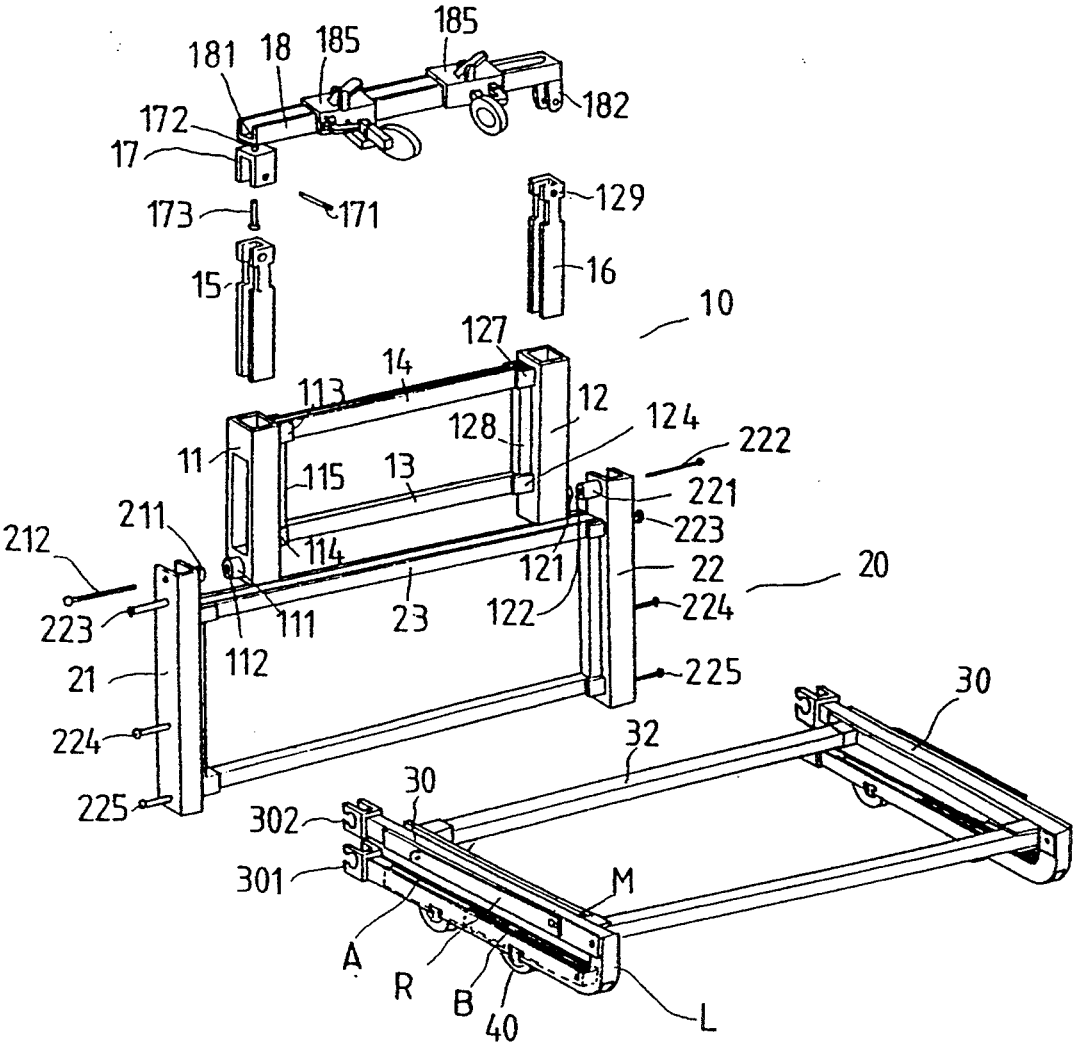
FIG. 1 is an exploded view of the present invention.
Figure 2:
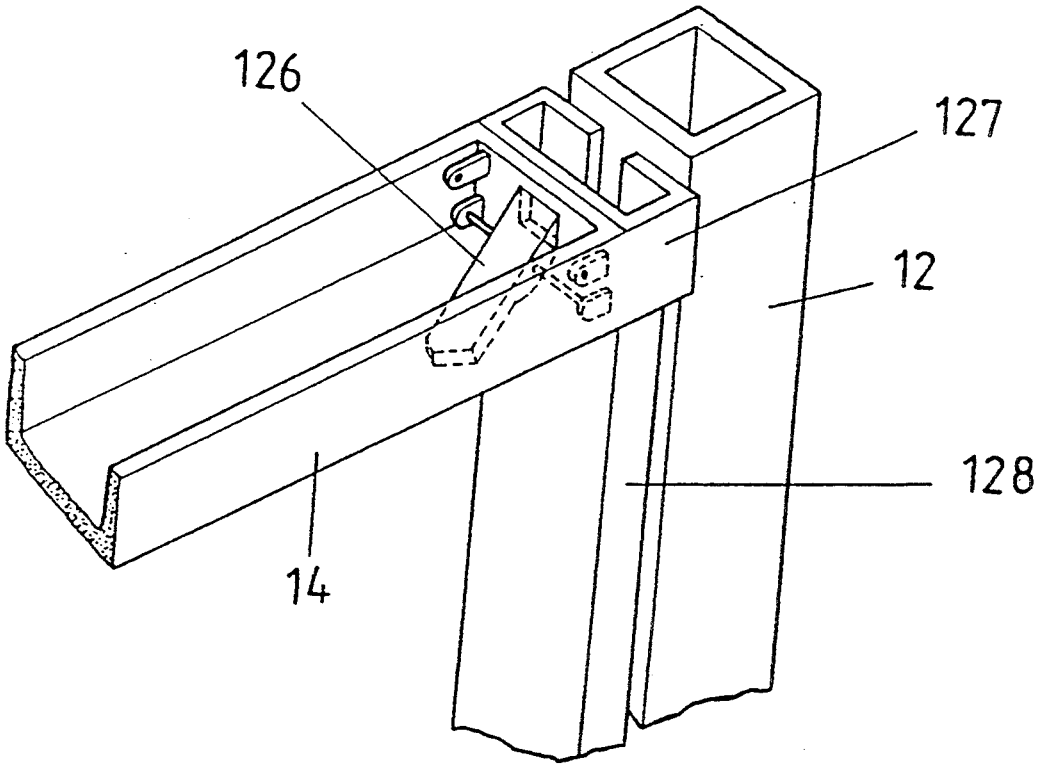
FIG. 2 shows the way to fix the slider in position.
Figure 3:
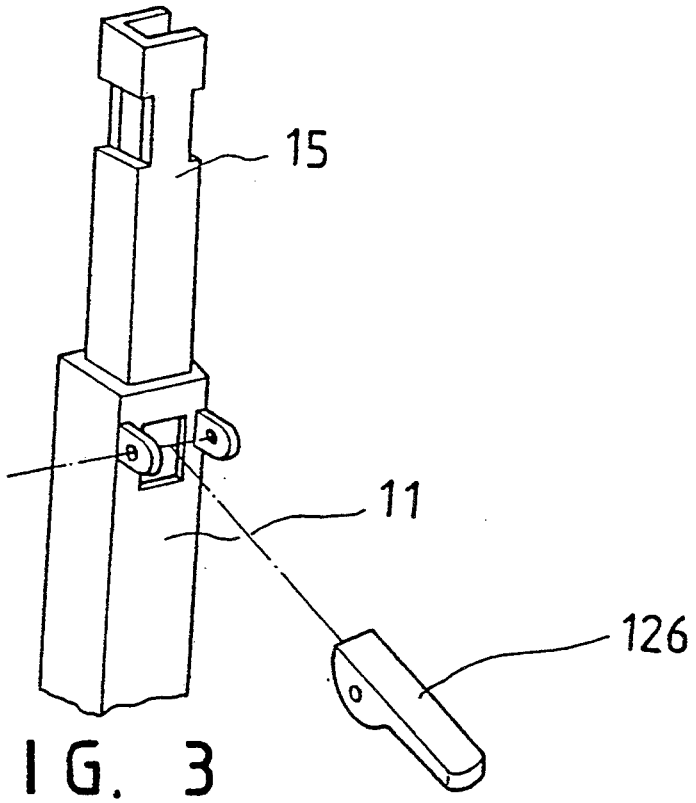
FIG. 3 shows the structure of the fixing device.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 5:
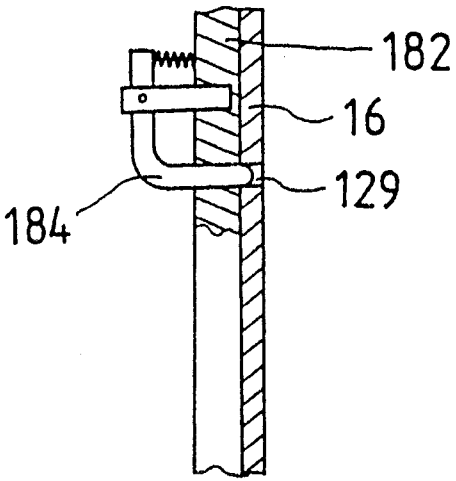
FIG. 5 shows the engagement between the lug and the telescopic rod.
Figure 4:
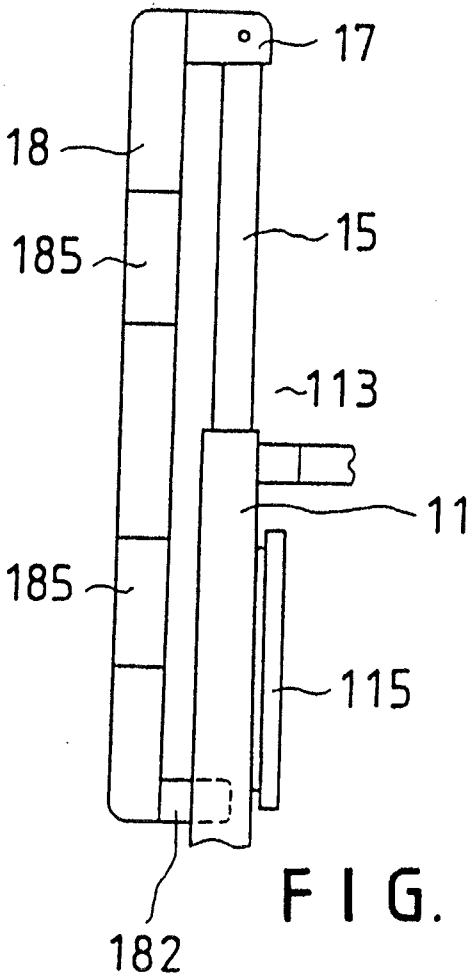
FIG. 4 shows the collapsed state of the headrest rod.
Figure 6:
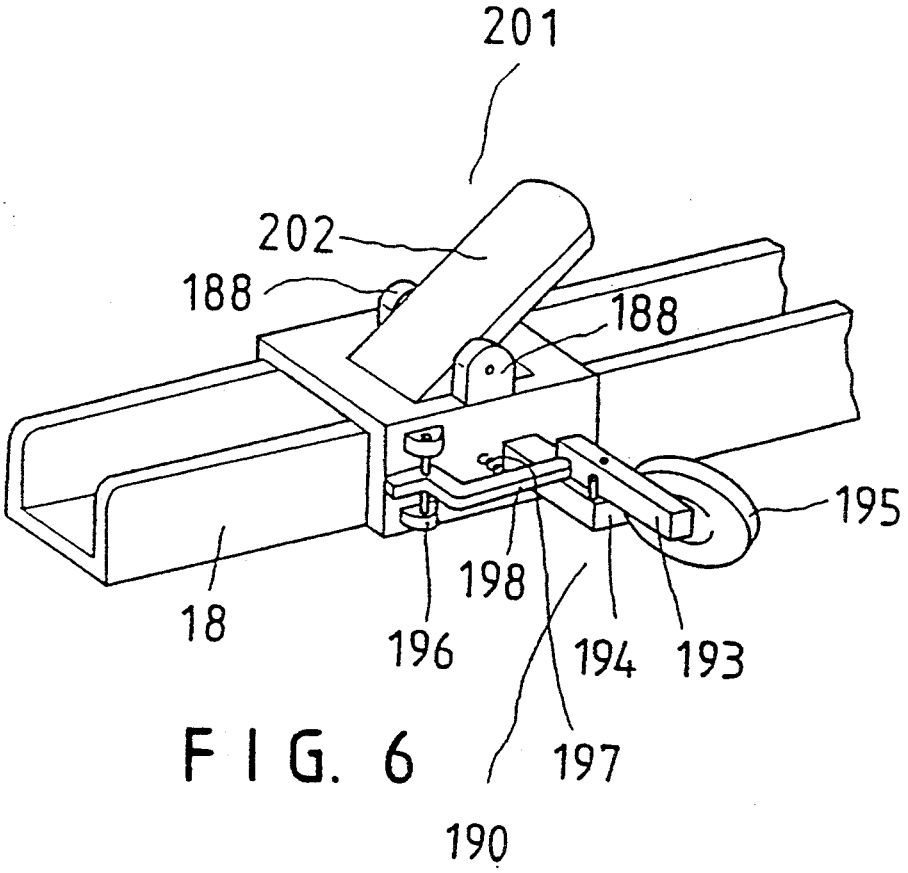
FIG. 6 shows the structure of the adjustable rest.
Figure 7:
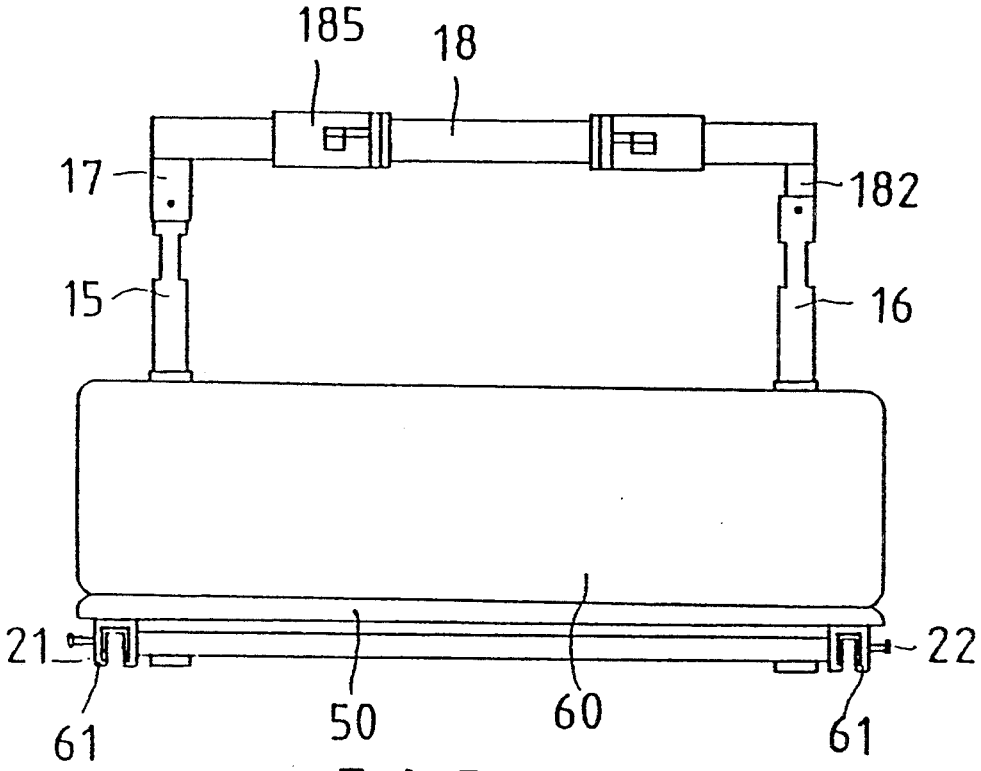
FIGS. 7, 7A and 7B show the way to use the present invention as a seat.
Figure 7A:
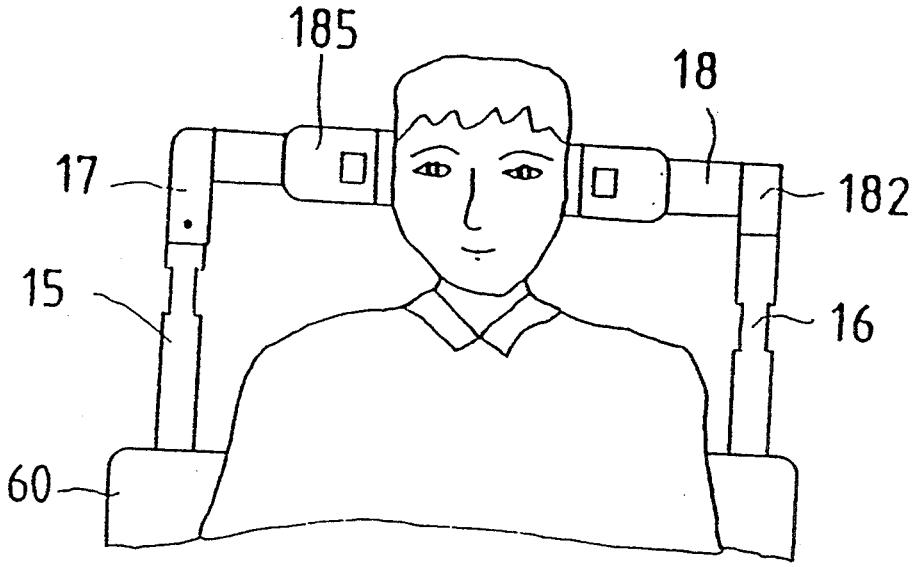
Figure 7B:
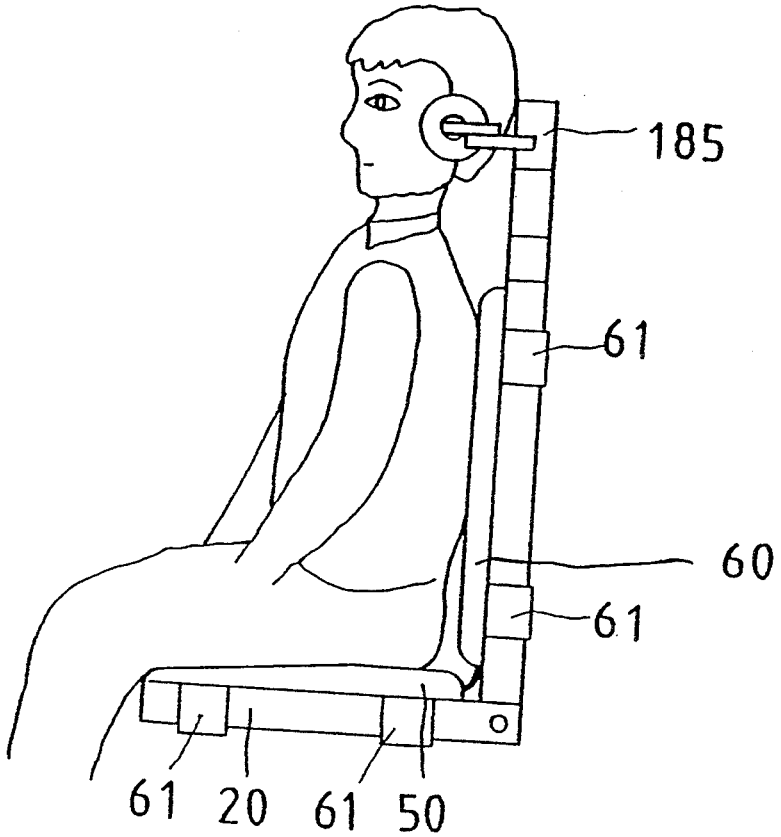
Figure 8:
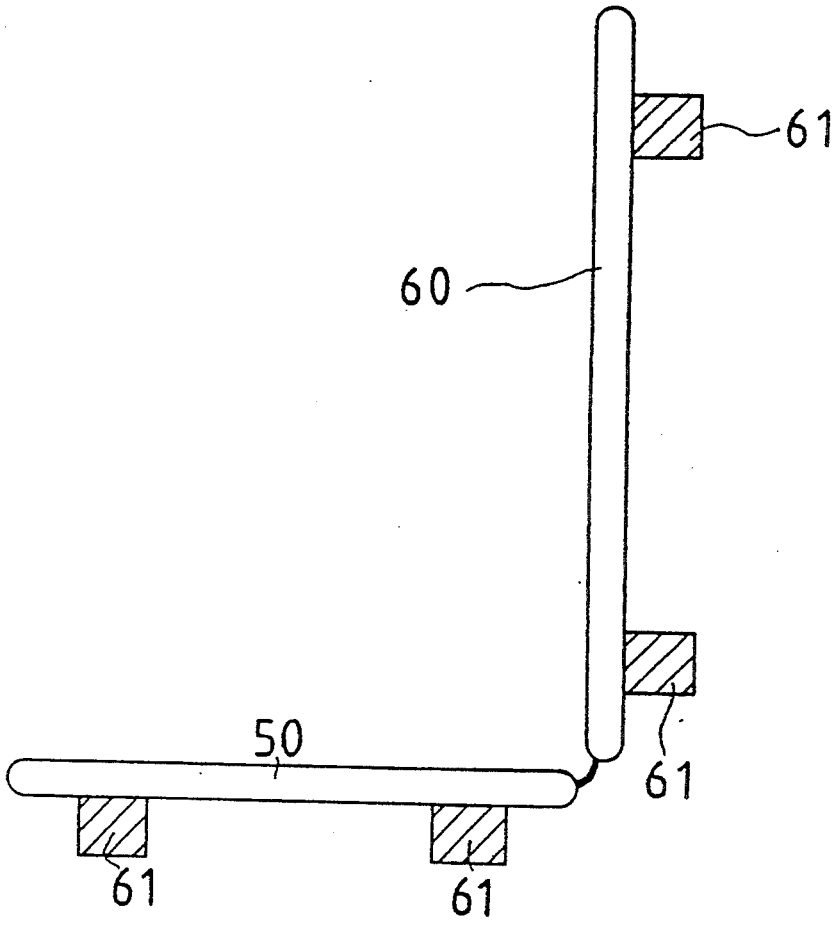
FIG. 8 shows the engagement between the back cushion and the pawls 61.

With reference to the drawings and in particular to FIGS. 1 through 14 thereof, the present invention mainly comprises an upper frame 10, a lower frame 20, a compound frame 30, a plurality of wheels 40, a seat cushion 50, a wheel frame 70, a seat 80 and a foot rest 90. The upper frame 10 is provided with a left upper support 11 and a right upper support 12 respectively having a left toothed member 111 and a right toothed member 121 at the lower end. The left lower support 21 and the right lower support 22 are respectively provided at the upper end with a first toothed member 211 and a second toothed member 221 which are respectively connected with the left toothed member 111 and the right toothed member 121 of the left upper support 11 and the right upper support 12 by screws 212 and 222. When desired to adjust the angle between the upper supports 11 and 12 and the lower supports 21 and 22, simply loosen the screws 212 and 222 and regulate the position of the upper supports 11 and 12. The upper supports 11 and 12 are respectively provided with fixing blocks 113 and 127, sliders 114 and 124, and guiding racks 115 and 128. A transverse rod 14 is mounted between the fixing blocks 113 and 127. A transverse rod 13 is fitted between the sliders 114 and 124. Hence, the transverse rods 14 and 13 may be moved up and down along the guiding racks 115 and 128 thereby enabling the upper frame 10 to be collapsed in stowage. The fixing blocks 127 and 113 are each provided with a positioning device 126 which is designed to fixedly mount the fixing blocks 127 and 113 on the guiding racks 128 and 115 respectively. The upper supports 11 and 12 are tubular members in which are inserted telescopic rods 15 and 16. Further, the supports 11 and 12 are each provided with a positioning device 126 for keeping the position of the telescopic rods 15 and 16. The upper end of the telescopic rod 15 is pivotally connected with a connector 17 by a pin 171. The top of the connector 17 has a hole 172 aligned with a hole 181 of a head rest rod 18 and the connector 17 is connected with the head rest rod 18 by a rivet 173. The right end of the head rest rod 18 has a lug 182 inserted into the upper end of the telescopic rod 16 and a pin 184 inserted into a hole 129 of the telescopic rod 16 so that the head rest rod 18 may be connected with the telescopic rod 16 (see FIG. 5). Further, the head rest rod 18 is provided with an adjustable rest 185 (see FIG. 6) having a positioning assembly 201 which has a fixing plate 202 pivotally mounted on two lugs 188. As the adjustable rest 185 is moved to the desired position, simply pressing the fixing late 202 to fixes the adjustable rest 185 on the head rest rod 18. When desired to regulate the position of the adjustable rest 185, pulling up the fixing plate 201 enables the adjustable rest 185 to move. In addition, the adjustable rest 185 has a swivel set 190 which has a rod 194 pivotally connected with a support bar 193 which is provided with a soft cushion 195. Moreover, the adjustable rest 185 is provided with a pair of lugs 196 pivotally connected with a Z-shaped rod 198 urged by a spring 197 so that the support bar 193 may be controlled by pressing the Z-shaped rod thereby controlling the position of the soft cushion 195.

Referring to FIGS. 7, 7A, 7B and 8, when the lower frame 20 is bent forward and the engaging members 61 of the back rest 60 are engaged with the two upper supports 11 and 12 of the upper rack 10 and the two lower supports 21 and 22 of the lower rack 20. Then, a back cushion 60 is mounted on the upper frame 10 and a seat cushion 50 on the lower frame 20 thereby forming a seat adapted for use in an automobile. Further, by means of the regulation of the adjustable rest 185, the user may seat steadily thereon.

Figure 9:
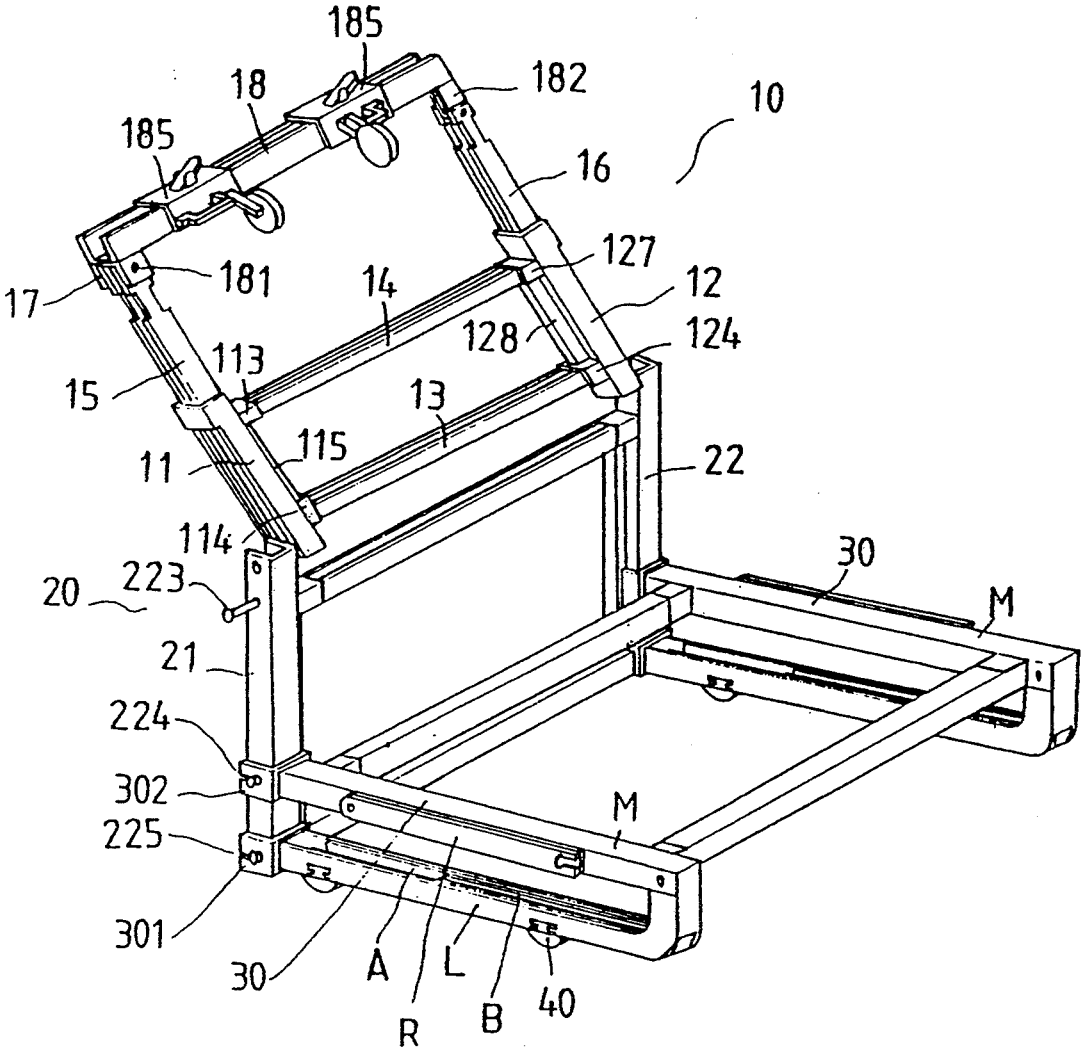
FIG. 9 shows the way to use the present invention as a wheeled chair.
Figure 10:
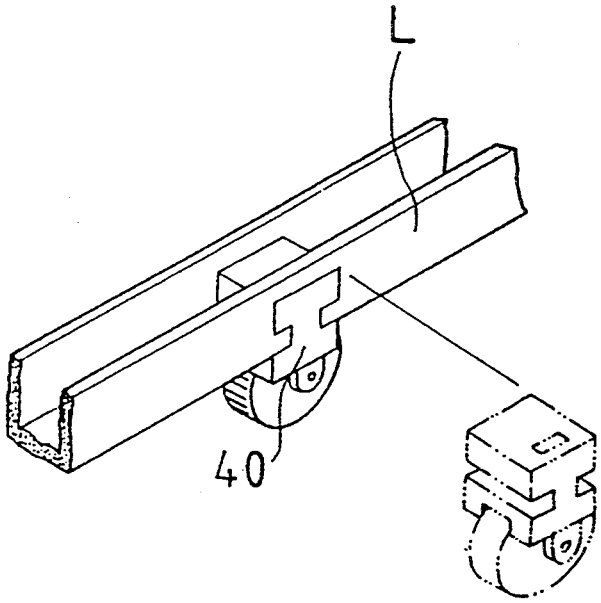
FIG. 10 is a perspective view of the wheel assembly.
Figure 10A:
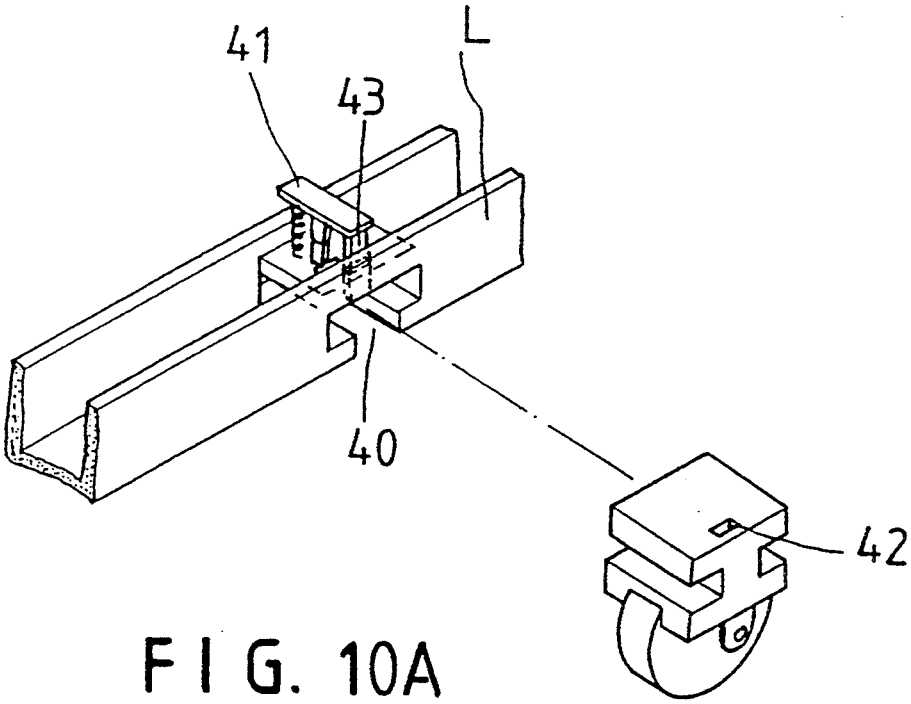
FIG. 10A is an exploded view of the wheel assembly.

FIG. 9 shows another working view of the present invention wherein the upper frame 10 is pivotally connected with the lower frame 20 and the compound frame 30 is engaged with the lower supports 21 and 22 by engaging the C-shaped openings 301 and 302 with the screws 225 and 224. Further, the compound frame 30 has a rod M at both sides and a rod L under each rod M. The bottom of the rod L, is provided with two wheel assemblies 40 and the rod L has a spring-loaded means 41 so that when the means 41 is pressed, a pin 43 of the means 41 will be inserted into a hole 42 of the wheel assembly 40 thereby keeping the wheel assembly 40 in position (see FIGS. 10 and 10A)

Figure 11:
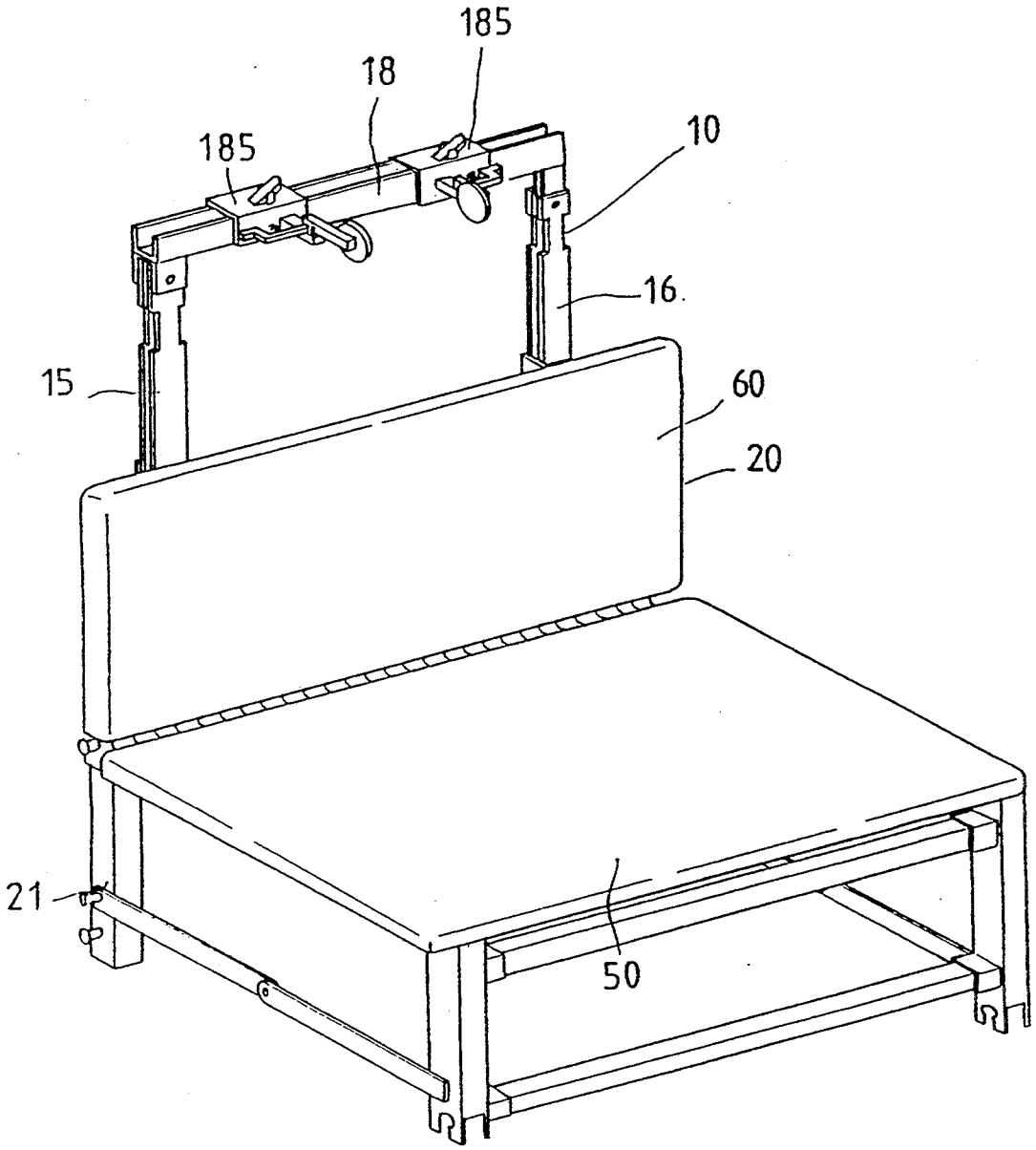
FIG. 11 shows the way to use the present invention as a chair.
Figure 11B:
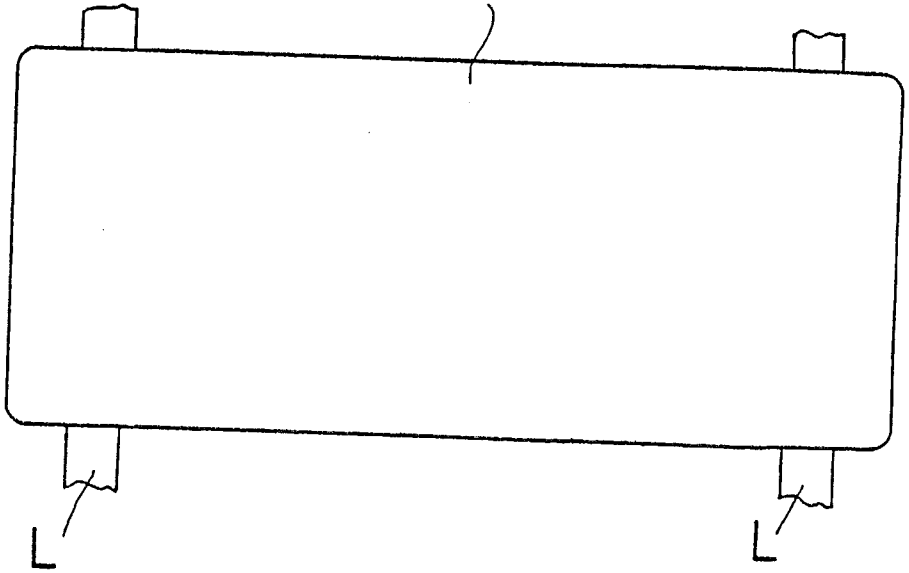
FIG. 11B is a top view of the chair.
Figure 11A:
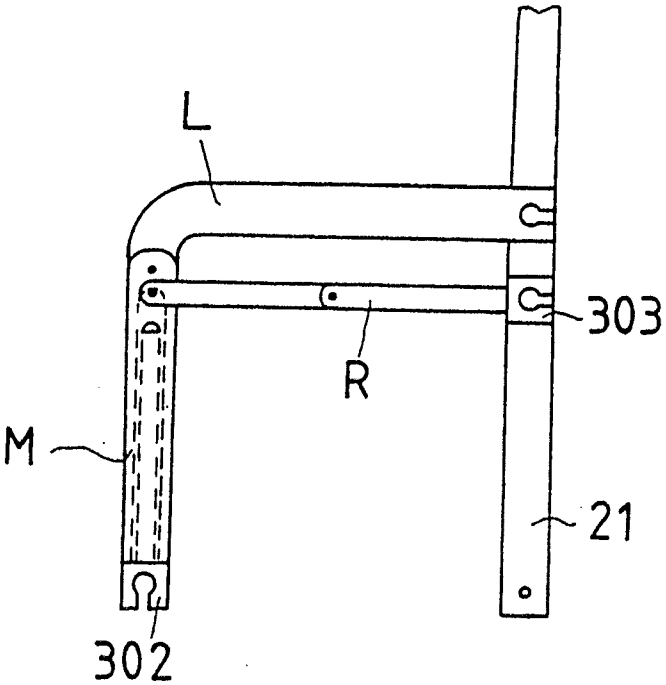
FIG. 11A is a side view of the chair.

FIGS. 11, 11A and 11B show another working view of the present invention wherein the wheel assemblies 40 are dismantled from the compound frame 30 and then the compound frame 30 is detached from the lower supports 21 and 22. Then, the compound frame 30 is turned over so that the rod M is located under the rod L. Then, the rod M is extended downwards and turned to have an angle of 90 degrees with the rod L. Thereafter, the C-shaped opening of the rod L is engaged with the screw 223 of the lower support 21. Then, the linking rod R is expanded and the C-shaped opening 303 is engaged with the screw 224 of the lower support 21 so as to reinforce the compound frame 30 and the lower frame 20. Then, the cushion 50 is mounted between the two rods L.

Figure 12:
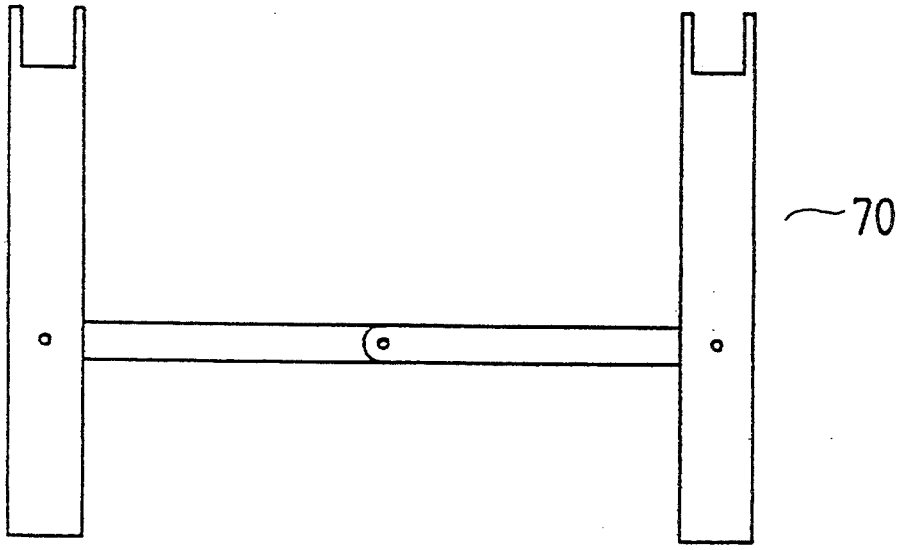
FIG. 12 shows the structure of a supporting frame.
Figure 13:
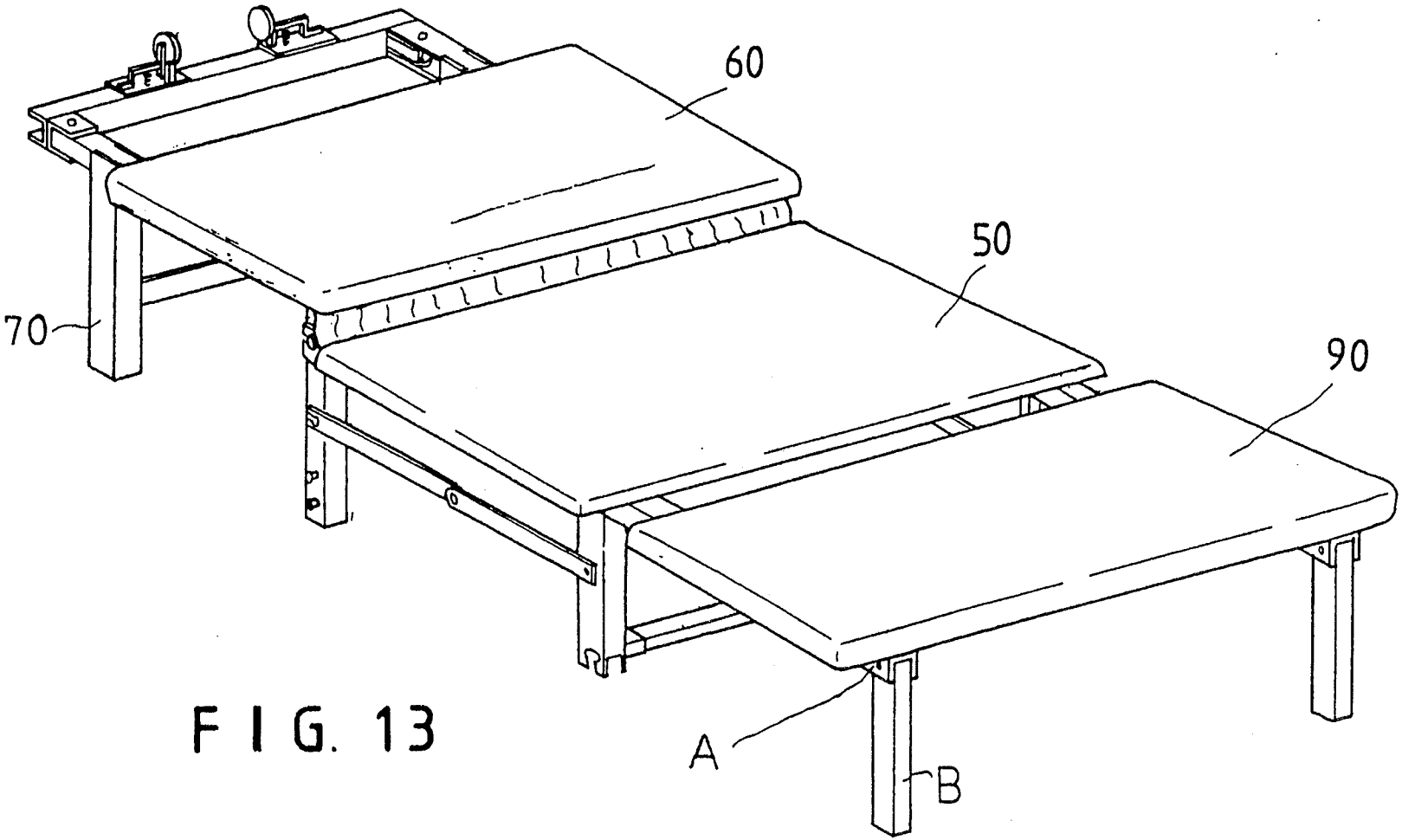
FIG. 13 shows the way to use the present invention as a bed.

FIG. 13 shows a third working view of the present invention, wherein the upper frame 10 is turned backwards making an angle of 90 degrees with the lower frame 20 and the telescopic rods 15 and 16 are supported by the supporting frame 70 (see FIG. 12). Then, the rods A and B in the rod L are drawn out to form another supporting frame and a foot cushion 90 is fitted between the two rods A.

Figure 14:
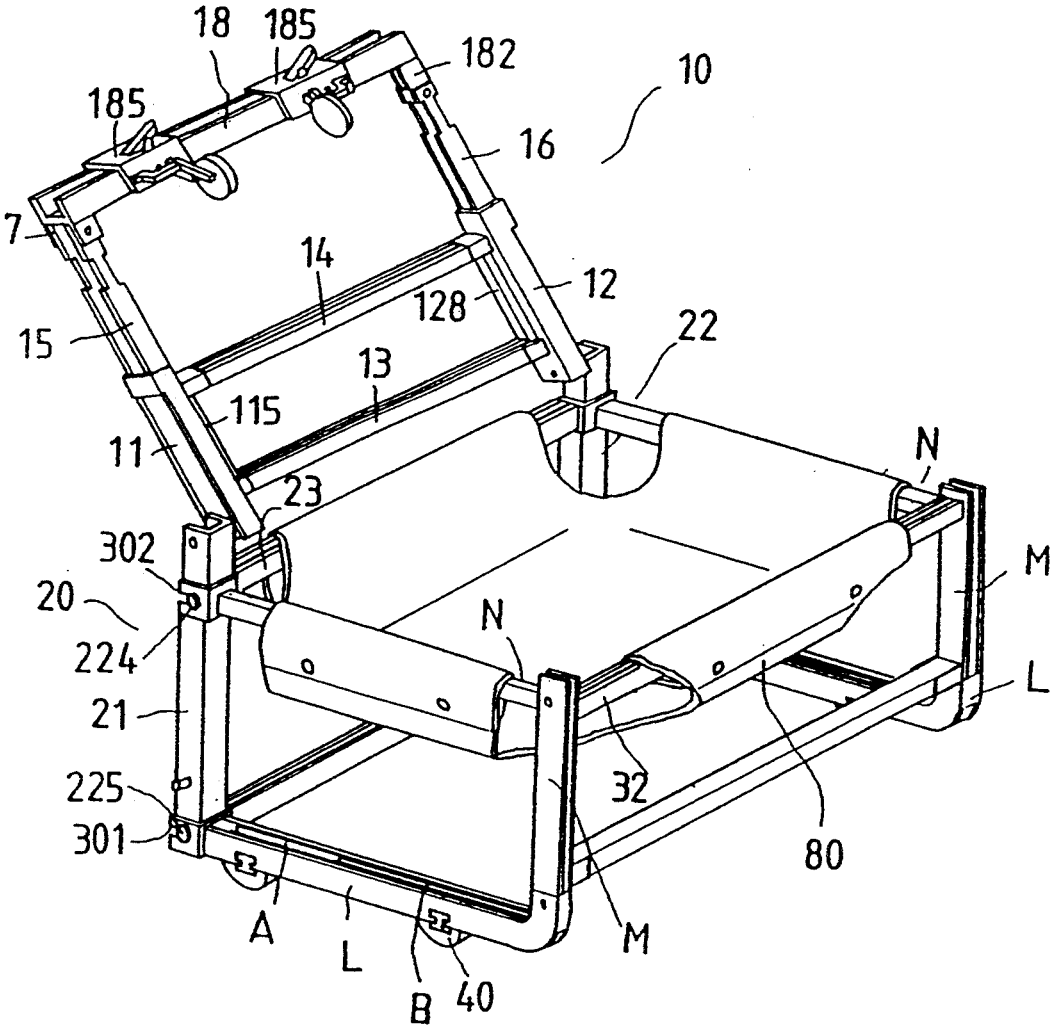
FIG. 14 shows the way to use the present invention as a baby carriage.

FIG. 14 shows a fourth working view of the present invention wherein the compound frame 30 is dismantled and the rod N in the rod M is pulled out making an angle of 90 degrees with the rod M and parallel to rod L. Then, the C-shaped opening 302 of the rod N is engaged with the screw 224 of the lower support 21. Then, the transverse rod 23 and 32, and two rods N form a rectangular frame and a baby seat 80 is mounted thereon to form a baby seat.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A multi-purpose carriage comprising:

an upper frame provided with two upper supports, each upper support having a toothed member at a lower end thereof, a guiding rack provided on each said upper support, a fixing block connected to one end of each said guiding rack, each said fixing block including a positioning device fixedly mounting said fixing block on a respective said guiding rack, a slider connected to another end of each said guiding rack, two transverse rods mounted between said two upper supports, each said transverse rod connected to a respective said fixing block and a respective said slider, a telescopic rod extending telescopically from an upper end of each said upper support, a head rest rod pivotally connected to an upper end of each said telescopic rod, and an adjustable rest connected to said head rest rod;

a lower frame including two lower supports, each said lower support connected to a respective said upper support and having a toothed member at an upper end thereof engaging a respective said toothed member of said upper supports; and a compound frame including two first rods, a second rod connected to each said first rod, and a plurality of wheel assemblies mounted on each said second rod, wherein at least one of said first rods and said second rods are connected to said lower supports of said lower frame.

2. The multi-purpose carriage as claimed in claim 1, wherein an end of each of said first and second rods is provided with a C-shaped opening detachably connected to said lower supports of said lower frame;

and further comprising a third rod pivotally connected each said first rod, each said third rod having a C-shaped opening at an end thereof.

* * * * *